US010619892B2

(12) United States Patent
Kim et al.

(10) Patent No.: US 10,619,892 B2
(45) Date of Patent: Apr. 14, 2020

(54) AIR CONDITIONING SYSTEM

(71) Applicant: LG ELECTRONICS INC., Seoul (KR)

(72) Inventors: Byeongsu Kim, Seoul (KR); Byoungjin Ryu, Seoul (KR); Beomchan Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 66 days.

(21) Appl. No.: 14/995,988

(22) Filed: Jan. 14, 2016

(65) Prior Publication Data

US 2016/0209085 A1 Jul. 21, 2016

(30) Foreign Application Priority Data

Jan. 15, 2015 (KR) ..... 10-2015-0007424

(51) Int. Cl.

| | |
|---|---|
| ***F25B 13/00*** | (2006.01) |
| ***F25B 25/00*** | (2006.01) |
| ***F24F 5/00*** | (2006.01) |
| ***F24F 1/06*** | (2011.01) |
| ***F24F 1/0059*** | (2019.01) |
| ***F24F 1/0007*** | (2019.01) |

(52) U.S. Cl.

CPC ..... *F25B 13/00* (2013.01); *F24F 1/0007* (2013.01); *F24F 1/0059* (2013.01); *F24F 1/00077* (2019.02); *F24F 1/06* (2013.01); *F24F 5/00* (2013.01); *F25B 25/005* (2013.01); *F24F 2221/54* (2013.01); *F25B 2313/003* (2013.01); *F25B 2313/007* (2013.01); *F25B 2313/021* (2013.01); *F25B 2313/02321* (2013.01); *F25B 2313/02344* (2013.01); *F25B 2500/221* (2013.01); *F25B 2500/23* (2013.01)

(58) Field of Classification Search

CPC ..... F25B 13/00; F25B 25/005; F24F 1/00077; F24F 1/0007; F24F 1/0059; F24F 1/06; F24F 5/00

See application file for complete search history.

(56) References Cited

U.S. PATENT DOCUMENTS 8,752,397 B2 * 6/2014 Yamashita ..... F24F 3/06 62/151
9,303,906 B2 * 4/2016 Morimoto ..... F25B 13/00
(Continued)

FOREIGN PATENT DOCUMENTS

EP 1724134 A2 * 11/2006 ..... B60H 1/00885
EP 2 495 514 A1 9/2012
(Continued)

*Primary Examiner* — Gordon A Jones
(74) *Attorney, Agent, or Firm* — Dentons US LLP

(57) ABSTRACT

An air conditioning system that includes at least one indoor unit that uses water as a working fluid, an outdoor unit that uses a refrigerant as a working fluid, the outdoor unit including a compressor compressing the refrigerant and an outdoor heat exchanger for heat-exchange with the refrigerant, and a heat collection unit connecting the at least one indoor unit to the outdoor unit, the heat collection unit including at least one heat exchange part for heat-exchanging water supplied from the at least one indoor unit with the refrigerant supplied from the outdoor unit.

10 Claims, 10 Drawing Sheets

(56) References Cited

U.S. PATENT DOCUMENTS

| | | | | |
|---|---|---|---|---|
| 2004/0139755 | A1* | 7/2004 | Han Park | F25B 5/02 62/199 |
| 2012/0036887 | A1* | 2/2012 | Wakamoto | F25B 13/00 62/513 |
| 2015/0027150 | A1* | 1/2015 | Cur | F24F 1/0003 62/115 |

FOREIGN PATENT DOCUMENTS

| | | | |
|---|---|---|---|
| EP | 2 693 134 | A1 | 2/2014 |
| EP | 2 728 277 | A1 | 5/2014 |
| JP | 2006125790 | A | 5/2006 |
| JP | 5442005 | B2 | 3/2014 |
| KR | 100499506 | B1 | 7/2005 |
| KR | 100539744 | B1 | 1/2006 |
| KR | 1020100030203 | A | 3/2010 |

* cited by examiner

AIR CONDITIONING SYSTEM

CROSS-REFERENCE TO RELATED APPLICATIONS

The present application claims the benefits of priority to Korean Patent Application No. 10-2015-0007424 (filed on Jan. 15, 2015), which is herein incorporated by reference in its entirety.

BACKGROUND

The present disclosure relates to an air conditioning system.

Air conditioning systems are systems that maintain air in a predetermined space in the most proper state according to use and purpose. In general, such an air conditioning system includes a compressor, a condenser, an expansion device, and evaporator. Thus, the air conditioner has a refrigerant cycle in which compression, condensation, expansion, and evaporation processes of a refrigerant are performed. Thus, the air conditioning system may heat or cool a predetermined space. In the air conditioning system, a synchronous variable refrigerant flow (VRF) system in which all of cooling and heating operations are enabled is receiving attention.

An air conditioning system that is a synchronous VRF system according to the related art is disclosed in Korean Patent Registration No. 10-0851906. In the air conditioning system, a heat collection unit may be disposed between an outdoor unit and an indoor unit, and refrigerant tubes connect the indoor and outdoor units to each other. In detail, the outdoor unit and the heat collection unit are connected to each other through three refrigerant tubes including a high pressure gas tube, an intermediate pressure gas tube, and a liquid tube, and the heat collection unit and the indoor unit are connected to each other through two refrigerant tubes. In the air conditioning system according to the related art, a valve in the heat collection unit is controlled according to an operation mode of the indoor unit to form an adequate refrigerant passage, thereby controlling the system.

Recently, due to the global warming by the refrigerant, systems for regulating the total amount of refrigerant are being made around the globe. However, in the air conditioning system according to the related art, an amount of refrigerant may increase due to the refrigerant filling according to the outdoor unit, the heat collection unit, the indoor unit, and a length of the refrigerant tube.

Also, since the introduction of the refrigerant into an indoor space is reluctant in North America or Europe, a chiller system, but the VRF system is widely used. However, in case of the chiller system, the chiller system is advantageous to refrigerant leakage and maintenance, but is disadvantageous in that partial load efficiency is deteriorated when compared to that of the VRF system.

Thus, in the air conditioning system, plans for reducing an amount of refrigerant in the whole system, preventing the refrigerant from leaking, and improving easy maintenance and partial load efficiency are seeking.

SUMMARY

Embodiments provide an air conditioning system that is capable of reducing an amount of refrigerant in the whole system, preventing the refrigerant from leaking, and improving easy maintenance and partial load efficiency.

In one embodiment, an air conditioning system includes: at least one indoor unit that uses water as a working fluid; an outdoor unit that uses a refrigerant as a working fluid, the outdoor unit including a compressor compressing the refrigerant and an outdoor heat exchanger for heat-exchange with the refrigerant; and a heat collection unit connecting the at least one indoor unit to the outdoor unit, the heat collection unit including at least one heat exchange part for heat-exchanging water supplied from the at least one indoor unit with the refrigerant supplied from the outdoor unit.

The at least one indoor unit and the heat collection unit may be connected to each other through a water tube through which the water circulates, and the outdoor unit and the heat collection unit may be connected to each other through a refrigerant tube through which the refrigerant circulates.

The heat exchange part may be provided in plurality.

The plurality of heat exchange parts may include: a first heat exchange part connected to the at least one indoor unit and the compressor of the outdoor unit; and a second heat exchange part connected to the at least one indoor unit and the outdoor heat exchanger of the outdoor unit.

The heat collection unit may include a heat exchange part connection tube connecting the first heat exchange part to the second heat exchange part and through which the refrigerant of the outdoor unit circulates.

The heat collection unit may include a check valve disposed in the heat exchange part connection tube to prevent the refrigerant from flowing backward.

The heat collection unit may include a flow rate adjustment valve disposed between the compressor of the outdoor unit and the first heat exchange part to adjust a flow rate of the refrigerant.

The flow rate adjustment valve may be closed when a cooling operation is performed and be opened when a heating operation is performed.

The heat collection unit may include a pair of flow guide valve guiding water introduced from the at least one indoor unit to the first heat exchange part or the second heat exchange part and guiding water discharged from the first heat exchange part or the second heat exchange part to the at least one indoor unit.

The flow guide valve may be provided in plural pairs.

The at least a pair of flow guide valves may include a three-way valve.

The at least a pair of flow guide valves may include a solenoid valve.

The heat collection unit may include an expansion valve disposed between the outdoor heat exchanger and the second heat exchange part.

The outdoor unit may include an outdoor unit expansion valve disposed between the expansion valve and the outdoor heat exchanger.

The outdoor unit may include an outdoor unit four-way valve connected to the first heat exchange part to convert a flow of the refrigerant.

The heat collection unit may include a first water pump disposed between the first heat exchange part and the at least one indoor unit to provide flow force of water flowing along the first heat exchange part.

The heat collection unit may include a second water pump disposed between the second het exchange part and the at least one indoor unit to provide flow force of water along the second heat exchange part.

The first heat exchange part may include a heat exchange part for heating, and the second heat exchange part may include a heat exchange part for cooling.

The at least one heat exchange part may include a plate type heat exchanger.

The details of one or more embodiments are set forth in the accompanying drawings and the description below. Other features will be apparent from the description and drawings, and from the claims.

DETAILED DESCRIPTION OF THE EMBODIMENTS

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
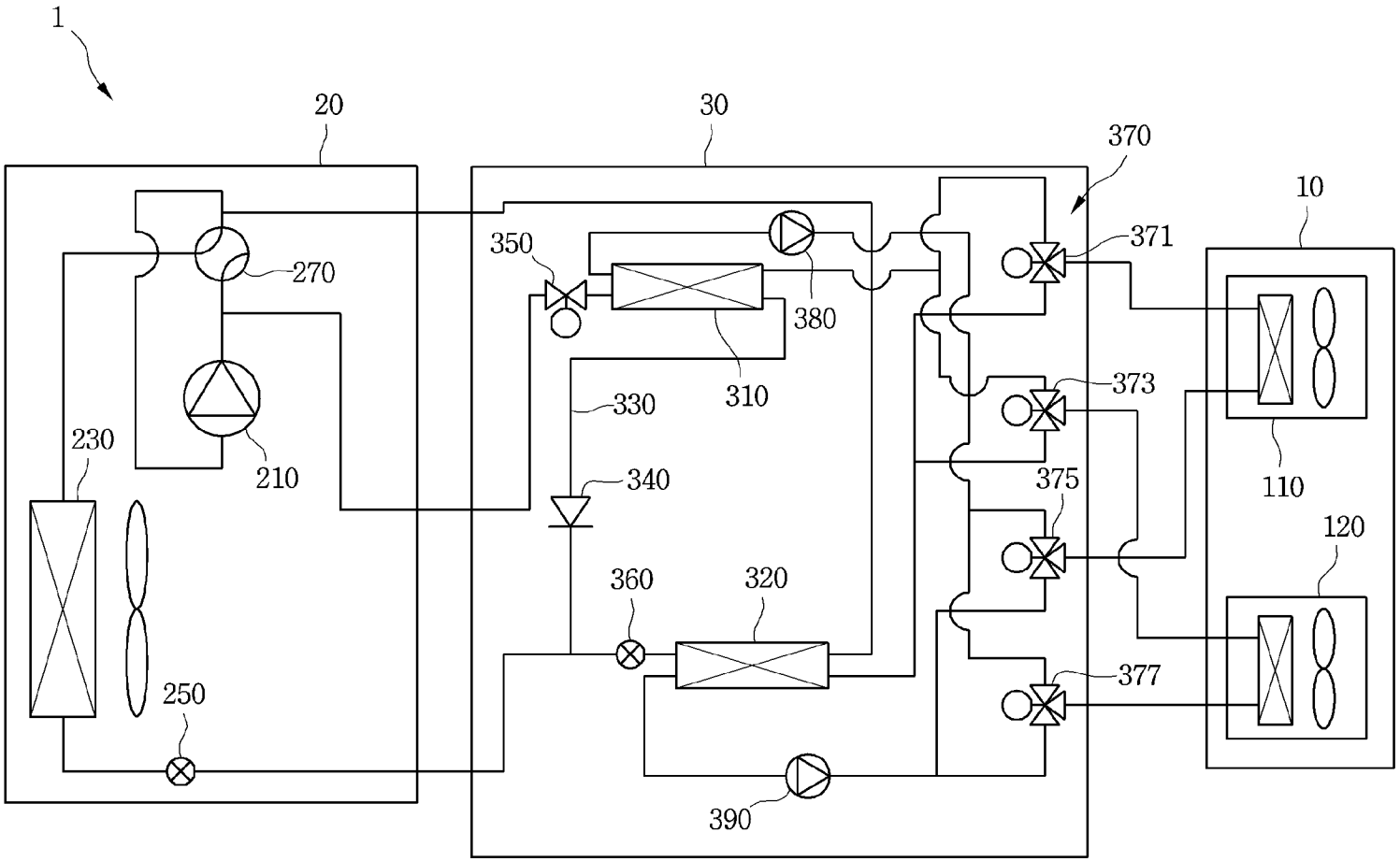
FIG. 1 is a view of an air conditioning system according to an embodiment.

FIG. 1 is a view of an air conditioning system according to an embodiment.

Referring to FIG. 1, an air conditioning system 1 may be a system in which all of cooling and heating operations are enabled. The air conditioning system 1 includes an outdoor unit 10, an indoor unit 20, and a heat collection unit 30.

The indoor unit 10 may be provided in one or plurality. That is, at least one indoor unit 10 may be provided. Hereinafter, in the current embodiment, a structure in which two indoor units, i.e., first and second indoor units 110 and 120 are provided will be exemplified.

The first and second indoor units 110 and 120 may use water as a working fluid. The first and second indoor units 110 and 120 may cool/heat an indoor space or purify indoor air.

The outdoor unit 20 is connected to the indoor unit 10 through the heat collection unit 30 that will be described in detail. The outdoor unit 20 may use a refrigerant as a working fluid. Also, compression and expansion of the refrigerant are performed in the outdoor unit 20. The outdoor unit 20 may be provided in one or plurality. Hereinafter, in the current embodiment, a structure in which one outdoor unit 20 is provided will be exemplified.

The outdoor unit 20 includes a compressor 210, an outdoor heat exchanger 230, an outdoor unit expansion valve 250, and an outdoor unit four-way valve 270.

The compressor 210 may be a component for compressing the refrigerant. The compressor 210 may operate by applying a voltage. When the voltage is applied to the compressor 210, the compressor 210 may compress the refrigerant.

The outdoor heat exchanger 230 may be a component for heat-exchange of the refrigerant. The outdoor heat exchanger 230 may perform evaporation or condensation of the refrigerant according to a cooling or heating operation of the air conditioning system 1.

The outdoor unit expansion valve 250 may be a component for adjusting a flow of the refrigerant into the outdoor heat exchanger 230. Since the outdoor unit expansion valve 250 is well known, its detailed description will be omitted below.

The outdoor unit four-way valve 270 may be a component for converting a flow direction of the refrigerant flowing through the outdoor unit 20. The outdoor unit four-way valve 270 may adequately convert the flow direction of the refrigerant according to the cooling or heating operation of the air conditioning system 1.

The heat collection unit 30 connects the indoor unit 10 to the outdoor unit 20 and performs heat-exchange between water supplied from the indoor unit 10 and the refrigerant supplied from the outdoor unit 20. For this, the heat collection unit 30 is connected to the indoor unit 10 through a water tube through which water circulates and connected to the outdoor unit 20 through a refrigerant tube through which the refrigerant circulates. That is to say, the indoor unit 10 and the heat collection unit 30 are connected to each other through the water tube, and the outdoor unit 20 and the heat collection unit 30 are connected to each other through the refrigerant tube.

The heat collection unit 30 includes heat exchange parts 310 and 320, a heat exchange part connection tube 330, a check valve 340, a flow rate adjustment valve 350, an expansion valve 360, a flow guide valve 370, and water pumps 380 and 390.

The heat exchange parts 310 and 320 may be components for the heat exchange between the water of the indoor unit 10 and the refrigerant of the outdoor unit 20. Each of the heat exchange parts 310 and 320 may be provided as a plate type heat exchanger. The heat exchange parts 310 and 320 may be provided in one or plurality. Hereinafter, in the current embodiment, a structure in which a plurality of heat exchange parts 310 and 320 are provided will be exemplified.

The plurality of heat exchange parts 310 and 320 include a first heat exchange part 310 and a second heat exchange part 320.

The first heat exchange part 310 may be provided as a heat exchange part for heating. The first heat exchange part 310 is connected to the indoor unit 10 and the compressor 210 of the outdoor unit 20. Here, the first heat exchange part 310 is connected to the indoor unit 10 through the water tube and connected to the compressor 210 through the refrigerant tube.

The second heat exchange part 320 may be provided as a heat exchange part for cooling. The second heat exchange part 320 is connected to the indoor unit 10 and the outdoor heat exchanger 230 of the outdoor unit 20. Here, the second heat exchange part 320 is connected to the indoor unit 10 through the water tube and connected to the outdoor heat exchanger 230 through the refrigerant tube.

The heat exchange part connection tube 330 is configured to allow the refrigerant of the outdoor unit 20 to flow. The heat exchange part connection tube 330 connects the first heat exchange part 310 to the second heat exchange part 320. Thus, the refrigerant discharged from the compressor 210 may flow into the second heat exchange part 320 via the first heat exchange part 310.

The check valve 340 may be a component for preventing the refrigerant discharged from the compressor 210 from flowing backward. The check valve 340 is disposed in the heat exchange part connection tube 330.

The flow rate adjustment valve 350 may be a component for adjusting a flow rate of the refrigerant discharged from the outdoor unit 10. The flow rate adjustment valve 350 is disposed between the compressor 210 of the outdoor unit 20 and the first heat exchange part 310. The flow rate adjustment valve 350 may be closed when the cooling operation of the air conditioning system 1 is performed and be opened when the heating operation of the air conditioning system 1 is performed.

The expansion valve 360 may be a component for adjusting a flow of the refrigerant from the second heat exchange part 320. The expansion valve 360 is disposed between the outdoor heat exchanger 230 of the outdoor unit 20 and the second heat exchange part 320. In more detail, the expansion valve 360 is disposed between the outdoor unit expansion valve 250 of the outdoor unit 20 and the second heat exchange part 320.

The flow guide valve 370 may be a component for guiding water introduced from the indoor unit 10 to the first heat exchange part 310 or the second heat exchange part 320 and guiding water discharged from the first exchange part 310 or the second heat exchange part 320 to the indoor unit 10.

The flow guide valve 370 may be provided as a three-way valve and provided in at least a pair or plurality of pairs. Hereinafter, in the current embodiment, a structure in which plural pairs of flow guide valves, i.e., three-wave valves are provided will be exemplified.

The plural pairs of flow guide valves 370 include a first flow guide valve 371, a second flow guide valve 373, a third flow guide valve 375, and a fourth flow guide valve 377.

The first flow guide valve 371 connects the first indoor unit 110, the first heat exchange part 310, and the second heat exchange part 320 to each other. The first flow guide valve 371 guides water introduced from the first indoor unit 110 to the first or second heat exchange part 310 or 320.

The second flow guide valve 373 connects the second indoor unit 120, the first heat exchange part 310, and the second heat exchange part 320 to each other. The second flow guide valve 373 guides water introduced from the second indoor unit 120 to the first or second heat exchange part 310 or 320.

The third flow guide valve 375 connects the first indoor unit 110, the first heat exchange part 310, and the second heat exchange part 320 to each other. The third flow guide valve 375 guides water discharged from the first or second heat exchange part 310 or 320 to the first indoor unit 110.

The fourth flow guide valve 377 connects the second indoor unit 120, the first heat exchange part 310, and the second heat exchange part 320 to each other. The fourth flow guide valve 377 guides water discharged from the first or second heat exchange part 310 or 320 to the second indoor unit 120.

The water pumps 380 and 390 may be components for providing flow force of water flowing along the heat exchange parts 310 and 320 and be respectively disposed between the heat exchange parts 310 and 320 and the indoor unit 10.

The water pumps 380 and 390 may be provided in one or plurality. That is, at least one or more water pumps 380 and 390 may be provided. Hereinafter, in the current embodiment, a structure in which a plurality of water pumps 380 and 390 are provided will be exemplified.

The plurality of water pumps 380 and 390 include a first water pump 389 and a second water pump 390.

The first water pumps 389 may provide flow force of water flowing along the first heat exchange part 310 and be disposed between the first heat exchange part 310 and the indoor unit 10.

The second water pumps 390 may provide flow force of water flowing along the second heat exchange part 320 and be disposed between the second heat exchange part 320 and the indoor unit 10.

Hereinafter, an operation of the air conditioning system 1 according to the current embodiment will be described in more detail.

FIGS. 2 to 5 are views illustrating flows of a refrigerant and water according to various operation modes in the air conditioning system of FIG. 1.

Figure 2:
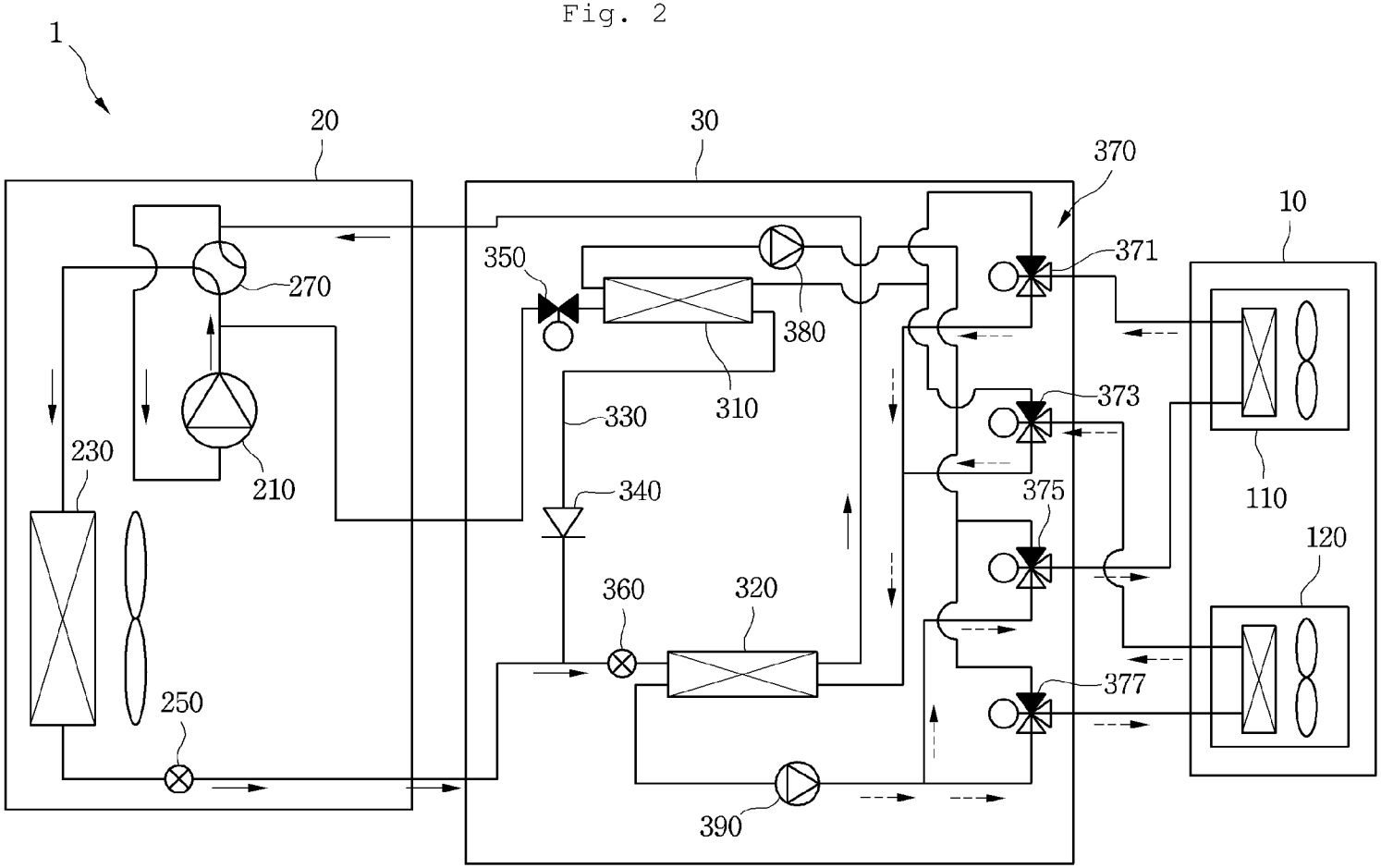
FIGS. 2 to 5 are views illustrating flows of a refrigerant and water according to various operation modes in the air conditioning system of FIG. 1.

FIG. 2 illustrates flows of a refrigerant and water according to a cooling operation mode of the air conditioning system 1 of FIG. 1. In FIG. 2, a solid arrow denotes a flow of a refrigerant, and a dotted line arrow denotes a flow of water.

Referring to FIG. 2, in terms of a flow of the refrigerant when the cooling operation is performed, a refrigerant discharged from the compressor 210 of the outdoor unit 20 is introduced into the outdoor heat exchanger 230 and then condensed. Here, the flow rate adjustment valve 350 of the heat collection unit 30 is closed. Thus, the refrigerant discharged from the compressor 210 may not be introduced into the first heat exchange part 310 of the heat collection unit 30.

The refrigerant condensed in the outdoor heat exchanger 230 is expanded via the expansion valve 360 of the heat collection unit 30 along the refrigerant tube and is heat-exchanged with cooling water introduced from the indoor unit 10 in the second heat exchange part 320 and then evaporated.

Also, the refrigerant evaporated through the heat-exchange with the cooling water in the second heat exchange part 320 of the heat collection unit 30 is introduced again into the compressor 210 via the outdoor unit four-way valve 270 of the outdoor unit 10 and then compressed again.

Hereinafter, in terms of a flow of the cooling water when the cooling operation is performed, the cooling water introduced from the indoor unit 10 may decrease in temperature through the heat exchange and then be discharged from the second heat exchange part 320.

Thereafter, the heat-exchanged cooling water may be introduced into each of the indoor units 110 and 120 through the flow guide valve 370 connected to each of the indoor units 110 and 120 and then be heat-exchanged with air to decrease a temperature of the air. Then, the cooling water may return to the second heat exchange part 320 of the heat collection unit 30.

Here, in terms of a flow of the cooling water in the indoor unit 100, the cooling water discharged from the first indoor unit 110 is introduced into the second heat exchange part 320 via the first flow guide valve 371 of the heat collection unit 30. Here, the first flow guide valve 371 may guide the cooling water to only the second heat exchange part 320 by closing a valve in a direction of the first heat exchange part 310 and opening a valve in a direction of the second heat exchange part 320.

The cooling water discharged from the second heat exchanger 110 is introduced into the second heat exchange part 320 via the second flow guide valve 373 of the heat collection unit 30. Here, the second flow guide valve 373 may guide the cooling water to only the second heat exchange part 320 by closing a valve in the direction of the first heat exchange part 310 and opening a valve in the direction of the second heat exchange part 320.

Thereafter, the cooling water discharged from the second heat exchange part 320 is introduced into each of the indoor units 110 and 120. Particularly, the cooling water discharged from the second heat exchange part 320 is introduced into the first indoor unit 110 via the third flow guide valve 375. Here, the third flow guide valve 375 may prevent the cooling water from flowing toward the first heat exchange part 310 by closing the valve in the direction of the first heat exchange part 310.

Also, the cooling water discharged from the second heat exchange part 320 is introduced into the second indoor unit 120 via the fourth flow guide valve 377. Here, the fourth flow guide valve 377 may prevent the cooling water from flowing toward the first heat exchange part 310 by closing the valve in the direction of the first heat exchange part 310.

Figure 3:
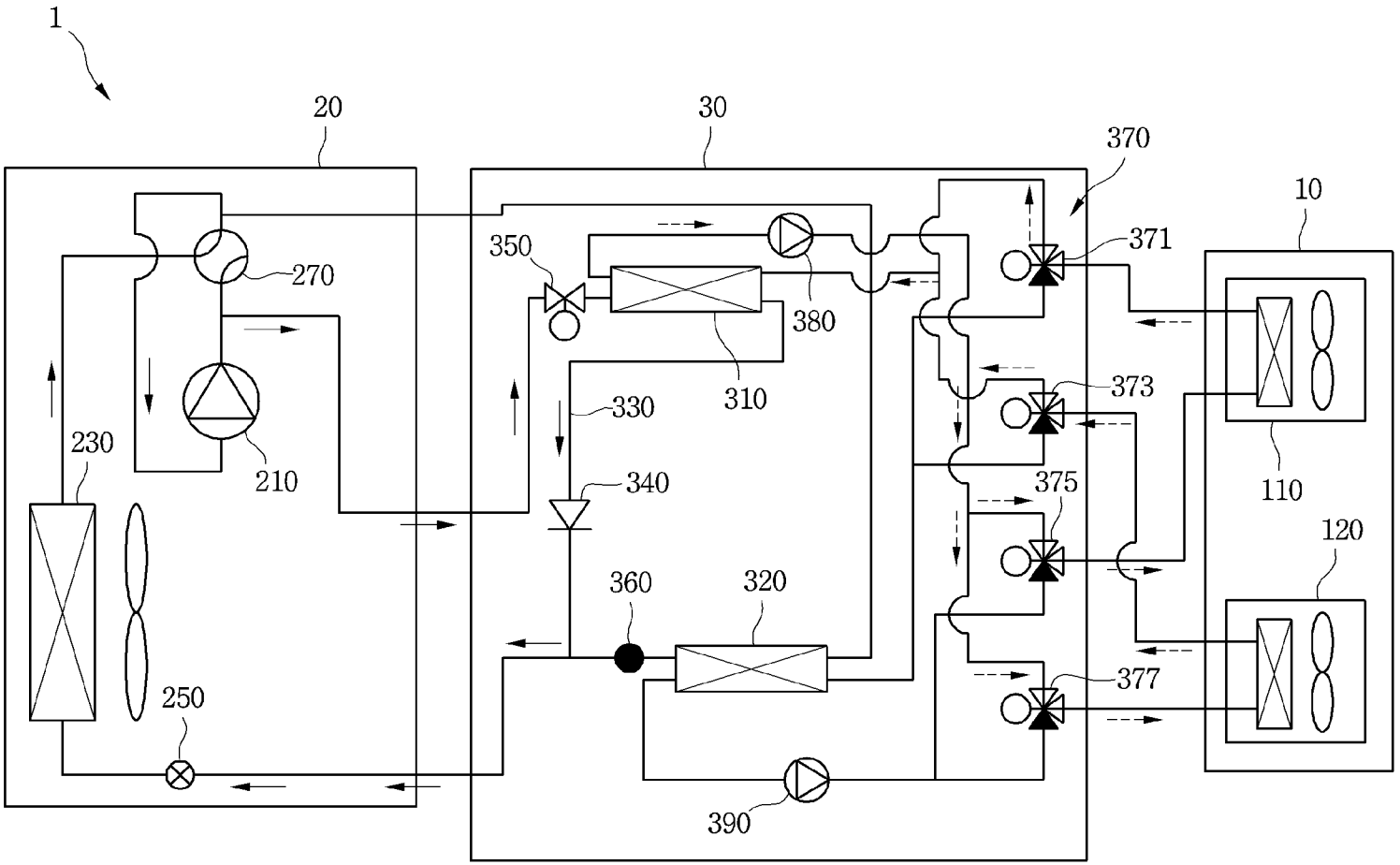

FIG. 3 illustrates flows of a refrigerant and water according to a heating operation mode of the air conditioning system 1 of FIG. 1. In FIG. 3, a solid arrow denotes a flow of a refrigerant, and a dotted line arrow denotes a flow of water.

Referring to FIG. 3, in terms of a flow of the refrigerant when the heating operation is performed, a refrigerant discharged from the compressor 210 of the outdoor unit 20 is introduced into the heat collection unit 30. Here, the outdoor unit four-way valve 270 of the outdoor unit 20 may convert a flow direction to prevent the refrigerant discharged from the compressor 210 from being introduced into the outdoor heat exchanger 230.

Also, the flow rate adjustment valve 350 of the heat collection unit 30 may be opened to guide the refrigerant discharged from the compressor 210 to the first heat exchange part 310 of the heat collection unit 30.

The refrigerant introduced into the first heat exchange part 310 is heat-exchanged with the cooling water introduced into the first heat exchange part 310 and then condensed in the first heat exchange part 310. The condensed refrigerant is introduced again into the outdoor unit 20 through the heat exchange part connection tube 330. Here, the expansion valve 360 of the heat collection unit 30 may be closed to prevent the condensed refrigerant from being introduced into the second heat exchange part 320.

The refrigerant introduced into the outdoor unit 20 is expanded via the outdoor unit expansion valve 250 and then evaporated in the outdoor heat exchanger 230. Thereafter, the evaporated refrigerant is introduced again into the compressor 210 via the outdoor unit four-way valve 270.

Hereinafter, in terms of a flow of the heating water when the heating operation is performed, the heating water introduced from the indoor unit 10 may increase in temperature through the heat exchange and then be discharged from the first heat exchange part 310.

Thereafter, the heat-exchanged heating water may be introduced into each of the indoor units 110 and 120 through the flow guide valve 370 connected to each of the indoor units 110 and 120 and then be heat-exchanged with air to increase a temperature of the air. Then, the heating water may return to the first heat exchange part 310 of the heat collection unit 30.

Here, in terms of a flow of the heating water in the indoor unit 100, the heating water discharged from the first indoor unit 110 is introduced into the first heat exchange part 310 via the first flow guide valve 371 of the heat collection unit 30. Here, the first flow guide valve 371 may guide the heating water to only the first heat exchange part 310 by opening the valve in the direction of the first heat exchange part 310 and closing the valve in the direction of the second heat exchange part 320.

The heating water discharged from the second heat exchanger 120 is introduced into the first heat exchange part 310 via the second flow guide valve 373 of the heat collection unit 30. Here, the second flow guide valve 373 may guide the heating water to only the first heat exchange part 310 by opening the valve in the direction of the first heat exchange part 310 and closing the valve in the direction of the second heat exchange part 320.

Thereafter, the heating water discharged from the first heat exchange part 310 is introduced into each of the indoor units 110 and 120. Particularly, the heating water discharged from the first heat exchange part 310 is introduced into the first indoor unit 110 via the third flow guide valve 375. Here, the third flow guide valve 375 may prevent the heating water from flowing toward the second heat exchange part 320 by closing the valve in the direction of the second heat exchange part 320.

Also, the heating water discharged from the first heat exchange part 310 is introduced into the second indoor unit 120 via the fourth flow guide valve 377. Here, the fourth flow guide valve 377 may prevent the heating water from flowing toward the second heat exchange part 320 by closing the valve in the direction of the second heat exchange part 320.

Figure 4:
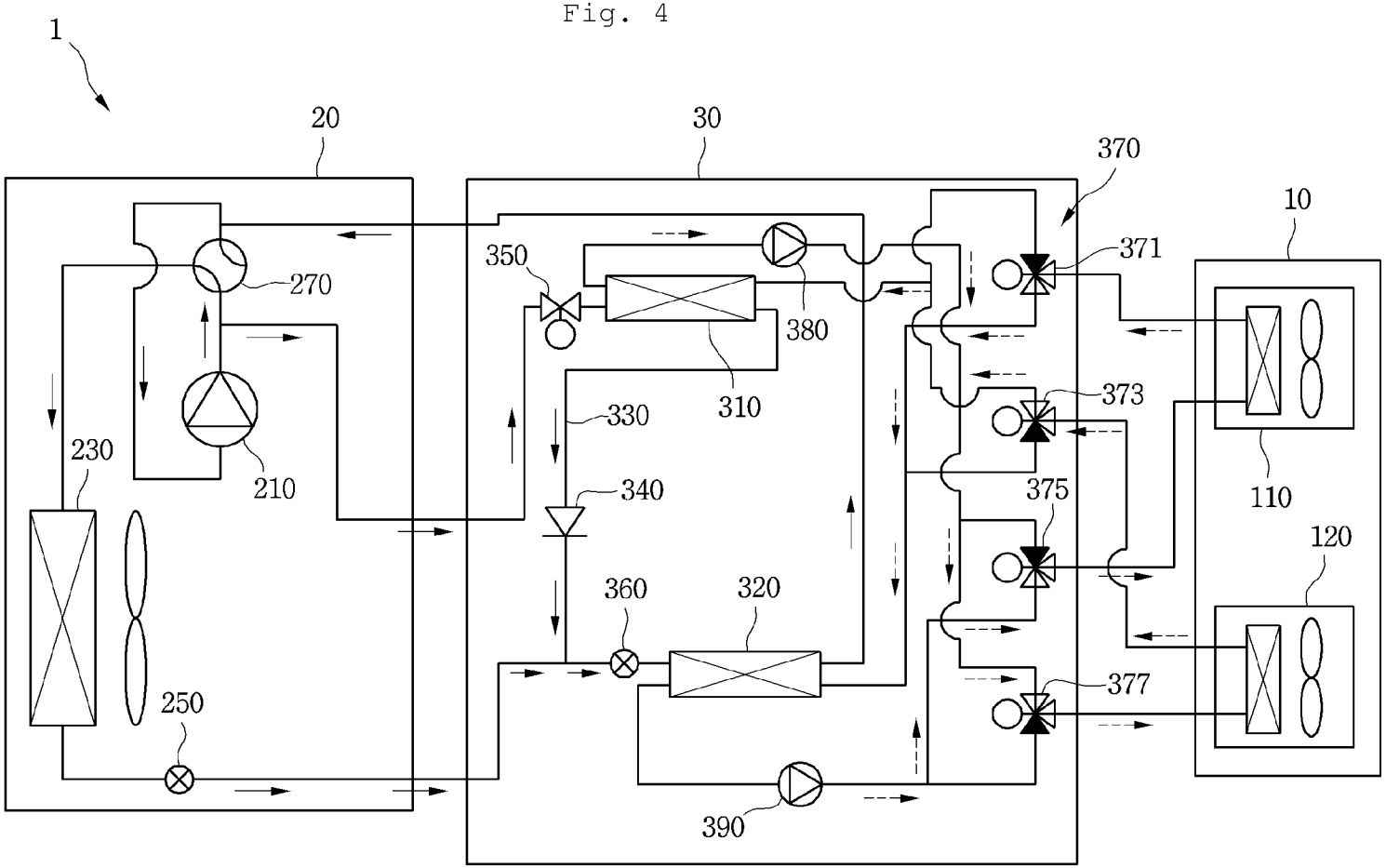

FIG. 4 illustrates flows of a refrigerant and water according to a cooling-main operation mode of the air conditioning system 1 of FIG. 1. In FIG. 4, a solid arrow denotes a flow of a refrigerant, and a dotted line arrow denotes a flow of water.

The cooling-main operation denotes an operation mode in which a plurality of indoor units perform the cooling operation, and a small number of indoor units perform the heating operation.

Referring to FIG. 4, in terms of a flow of the refrigerant when the cooling-main operation is performed, a refrigerant discharged from the compressor 210 of the outdoor unit 20 is introduced into each of the outdoor heat exchanger 210 of the outdoor unit 20 and the first heat exchange part 310 of the heat collection unit 30. For this, the flow rate adjustment valve 350 of the heat collection unit 30 is opened when the cooling-main operation is performed.

The refrigerant condensed in the outdoor heat exchanger 210 of the outdoor unit 20 is introduced into the heat collection unit 30. Also, the refrigerant introduced into the first heat exchange part 310 of the heat collection unit 30 may also be heat-exchanged with the heating water of the second indoor unit 120 and condensed and then be introduced into the heat exchange part connection tube 330.

Thereafter, the two condensed refrigerants may be expanded in the expansion valve 360 of the heat collection unit 30 and then introduced into the second heat exchange part 320 of the heat collection unit 30. The refrigerant introduced into the second heat exchange part 320 is heat-exchanged with the cooling water of the first indoor unit 110 to decrease a temperature of the cooling water and then evaporated.

Also, the refrigerant evaporated through the heat-exchange with the cooling water in the second heat exchange part 320 of the heat collection unit 30 is introduced again into the compressor 210 via the outdoor unit four-way valve 270 of the outdoor unit 10 and then compressed again.

Hereinafter, flows of the cooling water and heating water when the cooling-main operation is performed will be described. The heating water and the cooling water, which are heated-exchanged in the first and second heat exchange parts 310 and 320 of the heat collection unit 30 may pass through the flow guide valve 370 connected to each of the indoor units 10 according to the operation mode of each of the indoor units 10 to perform the heating or cooling operation and then return to the heat exchange parts 310 and 320.

Hereinafter, in the current embodiment, a structure in which the first indoor unit 110 performs the cooling operation, and the second indoor unit 120 performs the heating operation when the cooling-main operation mode is performed will be described.

First, in terms of a flow of the cooling water when the cooling-main operation is performed, the cooling water discharged from the first indoor unit 110 is introduced into the second heat exchange part 320 via the first flow guide valve 371 of the heat collection unit 30. Here, the first flow guide valve 371 may guide the cooling water to only the second heat exchange part 320 by closing the valve in the direction of the first heat exchange part 310 and opening the valve in the direction of the second heat exchange part 320.

Thereafter, the cooling water is heat-exchanged with the refrigerant in the second heat exchange part 320 to decrease in temperature and then is discharged from the second heat exchange part 320. The cooling water discharged from the second heat exchange part 320 is introduced into the first indoor unit 110 via the third flow guide valve 375. Here, the third flow guide valve 375 may prevent the cooling water from flowing toward the first heat exchange part 310 by closing the valve in the direction of the first heat exchange part 310.

The heat-exchanged cooling water may be introduced into the first indoor unit 110 and heat-exchanged with air to decrease a temperature of the air. Then, the cooling water may return to the second heat exchange part 320 of the heat collection unit 30.

Also, in terms of a flow of the heating water when the cooling-main operation is performed, the heating water discharged from the second indoor unit 120 is introduced into the first heat exchange part 310 via the second flow guide valve 373 of the heat collection unit 30. Here, the second flow guide valve 373 may guide the heating water to only the first heat exchange part 310 by opening the valve in the direction of the first heat exchange part 310 and closing the valve in the direction of the second heat exchange part 320.

Thereafter, the heating water is heat-exchanged with the refrigerant in the first heat exchange part 310 to increase in temperature and then is discharged from the first heat exchange part 310. The heating water discharged from the first heat exchange part 310 is introduced into the second indoor unit 120 via the fourth flow guide valve 377. Here, the fourth flow guide valve 377 may prevent the heating water from flowing toward the second heat exchange part 320 by closing the valve in the direction of the second heat exchange part 320.

The heat-exchanged heating water may be introduced into the second indoor unit 120 and heat-exchanged with air to increase a temperature of the air. Then, the cooling water may return to the first heat exchange part 310 of the heat collection unit 30.

Figure 5:
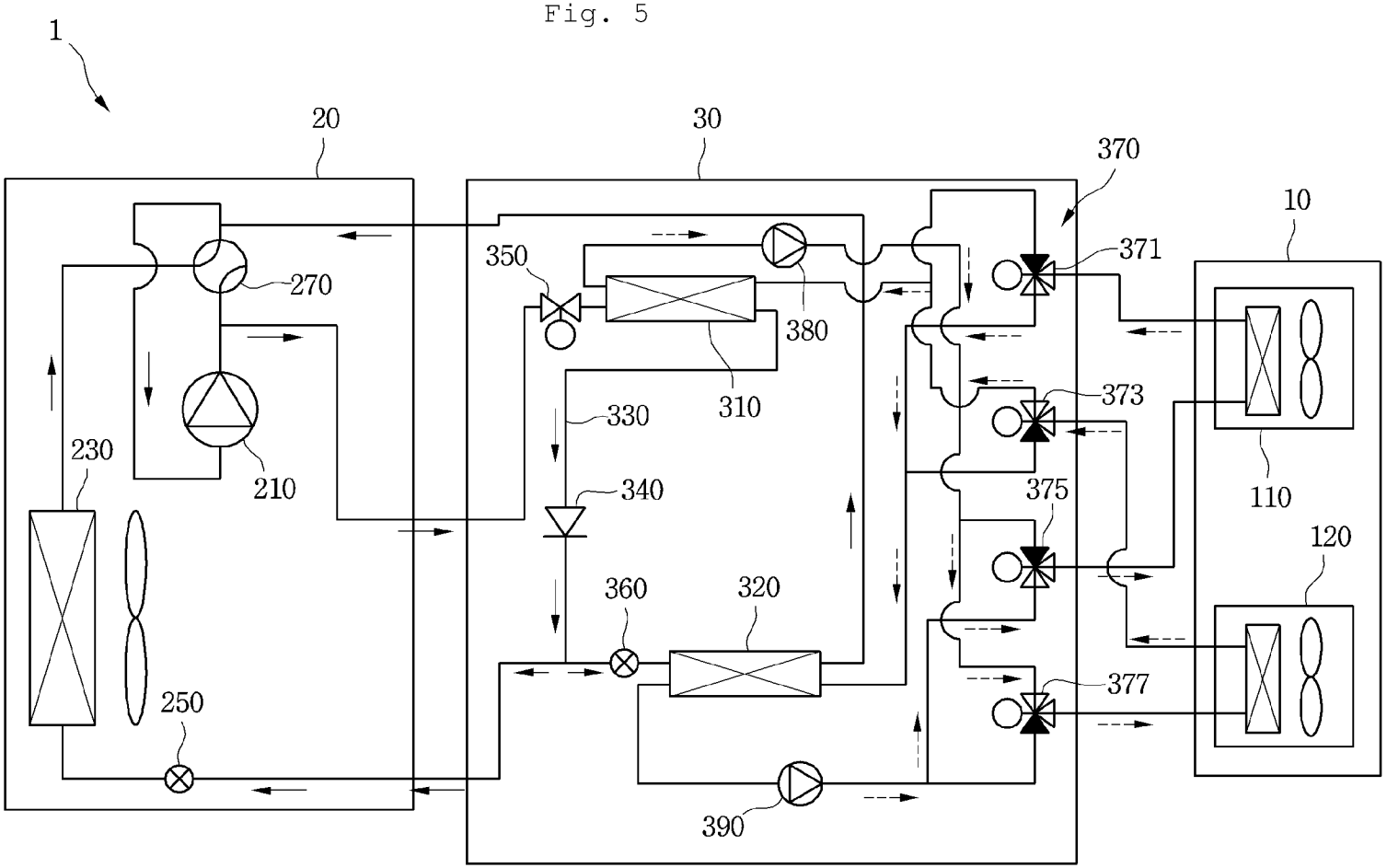

FIG. 5 illustrates flows of a refrigerant and water according to a heating-main operation mode of the air conditioning system 1 of FIG. 1. In FIG. 5, a solid arrow denotes a flow of a refrigerant, and a dotted line arrow denotes a flow of water.

The heating-main operation denotes an operation mode in which a plurality of indoor units perform the heating operation, and a small number of indoor units perform the cooling operation.

Referring to FIG. 5, in terms of a flow of the refrigerant when the heating-main operation is performed, a refrigerant discharged from the compressor 210 of the outdoor unit 20 is introduced into the heat collection unit 30. Here, the outdoor unit four-way valve 270 of the outdoor unit 20 may convert a flow direction to prevent the refrigerant discharged from the compressor 210 from being introduced into the outdoor heat exchanger 230.

Also, the flow rate adjustment valve 350 of the heat collection unit 30 may be opened to guide the refrigerant discharged from the compressor 210 to the first heat exchange part 310 of the heat collection unit 30.

The refrigerant introduced into the first heat exchange part 310 is heat-exchanged with the heating water of the second indoor unit 120 and condensed and then be introduced into the heat exchange part connection tube 330. Thereafter, the condensed refrigerant is branched into the outdoor unit 200 and the second heat exchange part 320 of the heat collection unit 30.

The refrigerant introduced into the outdoor unit 20 is expanded via the outdoor unit expansion valve 250 of the outdoor unit 20 and then evaporated in the outdoor unit heat exchanger 230 of the outdoor unit 20. The evaporated refrigerant is introduced again into the compressor 210 via the outdoor unit four-way valve 270 and then is compressed again.

The refrigerant branched into the second heat exchange part 320 of the heat collection unit 30 is expanded via the expansion valve 360 of the heat collection unit 30 and is introduced into the second heat exchange part 320. Then, the refrigerant is heat-exchanged with the cooling water of the first indoor unit 110 and then evaporated. Thereafter, the refrigerant evaporated in the second heat exchange part 320 is introduced into the outdoor unit 20 and mixed with the refrigerant evaporated in the outdoor heat exchanger 230 and then is introduced again into the compressor 210.

Hereinafter, flows of the cooling water and heating water when the heating-main operation is performed will be described. The heating water and the cooling water, which are heated-exchanged in the first and second heat exchange parts 310 and 320 of the heat collection unit 30 may pass through the flow guide valve 370 connected to each of the indoor units 10 according to the operation mode of each of the indoor units 10 to perform the heating or cooling operation and then return to the heat exchange parts 310 and 320.

Hereinafter, in the current embodiment, a structure in which the first indoor unit 110 performs the cooling operation, and the second indoor unit 120 performs the heating operation when the heating-main operation mode is performed will be described.

First, in terms of a flow of the cooling water when the heating-main operation is performed, the cooling water discharged from the first indoor unit 110 is introduced into the second heat exchange part 320 via the first flow guide valve 371 of the heat collection unit 30. Here, the first flow guide valve 371 may guide the cooling water to only the second heat exchange part 320 by closing the valve in the direction of the first heat exchange part 310 and opening the valve in the direction of the second heat exchange part 320.

Thereafter, the cooling water is heat-exchanged with the refrigerant in the second heat exchange part 320 to decrease in temperature and then is discharged from the second heat exchange part 320. The cooling water discharged from the second heat exchange part 320 is introduced into the first indoor unit 110 via the third flow guide valve 375. Here, the third flow guide valve 375 may prevent the cooling water from flowing toward the first heat exchange part 310 by closing the valve in the direction of the first heat exchange part 310.

The heat-exchanged cooling water may be introduced into the indoor unit 110 and heat-exchanged with air to decrease a temperature of the air. Then, the cooling water may return to the second heat exchange part 320 of the heat collection unit 30.

Also, in terms of a flow of the heating water when the heating-main operation is performed, the heating water discharged from the second indoor unit 120 is introduced into the first heat exchange part 310 via the second flow guide valve 373 of the heat collection unit 30. Here, the second flow guide valve 373 may guide the heating water to only the first heat exchange part 310 by opening the valve in the direction of the first heat exchange part 310 and closing the valve in the direction of the second heat exchange part 320.

Thereafter, the heating water is heat-exchanged with the refrigerant in the first heat exchange part 310 to increase in temperature and then is discharged from the first heat exchange part 310. The heating water discharged from the first heat exchange part 310 is introduced into the second indoor unit 120 via the fourth flow guide valve 377. Here, the fourth flow guide valve 377 may prevent the heating water from flowing toward the second heat exchange part 320 by closing the valve in the direction of the second heat exchange part 320.

The heat-exchanged heating water may be introduced into the second indoor unit 120 and heat-exchanged with air to increase a temperature of the air. Then, the cooling water may return to the first heat exchange part 310 of the heat collection unit 30.

As described above, in the air conditioning system 1 according to the current embodiment, since the refrigerant tube through which the refrigerant discharged from the outdoor unit 20 flows is connected to only the outdoor unit 20 and the heat collection unit 30, the refrigerant tube of the air conditioning system 1 may be reduced in length.

Thus, in the air conditioning system 1 according to the current embodiment, an amount of refrigerant in the whole system may be reduced. Therefore, since the total amount of refrigerant is reduced in the air conditioning system 1 according to the current embodiment, possibility that is capable of being excluded from the regulation object with respect to an amount of refrigerant in the recent years may significantly increase.

Also, in the air conditioning system 1 according to the current embodiment, since a refrigerant circulation system in which the outdoor unit 20 and the heat collection unit 30 are connected to each other through the refrigerant tube is realized, partial load operation efficiency may be improved.

Thus, in the air conditioning system 1 according to the current embodiment, the partial load operation efficiency may be improved to significantly improve energy efficiency.

Furthermore, in the air conditioning system 1 according to the current embodiment, since the indoor unit 10 uses water as the working fluid, the air conditioning system 1 may be compatible with the existing chiller system.

Thus, in the air conditioning system 1 according to the current embodiment, all of the cooling and heating operations may be performed in the indoor unit 10 that uses water as the working fluid, unlike the chiller system in which only the existing cooling operation is possible.

Also, in the air conditioning system 1 according to the current embodiment, since water is used as the working fluid in the indoor unit 10, the refrigerant leakage from the indoor unit 10 may be prevented. Also, when the indoor unit 10 is repaired, a cumbersome process for filling and discharging the refrigerant may be unnecessary.

Thus, in the air conditioning system 1 according to the current embodiment, a time or cost that is consumed for repairing the system later may be significantly reduced.

Hereinafter, an air conditioning system 1 according to another embodiment will be described in more detail.

Figure 6:
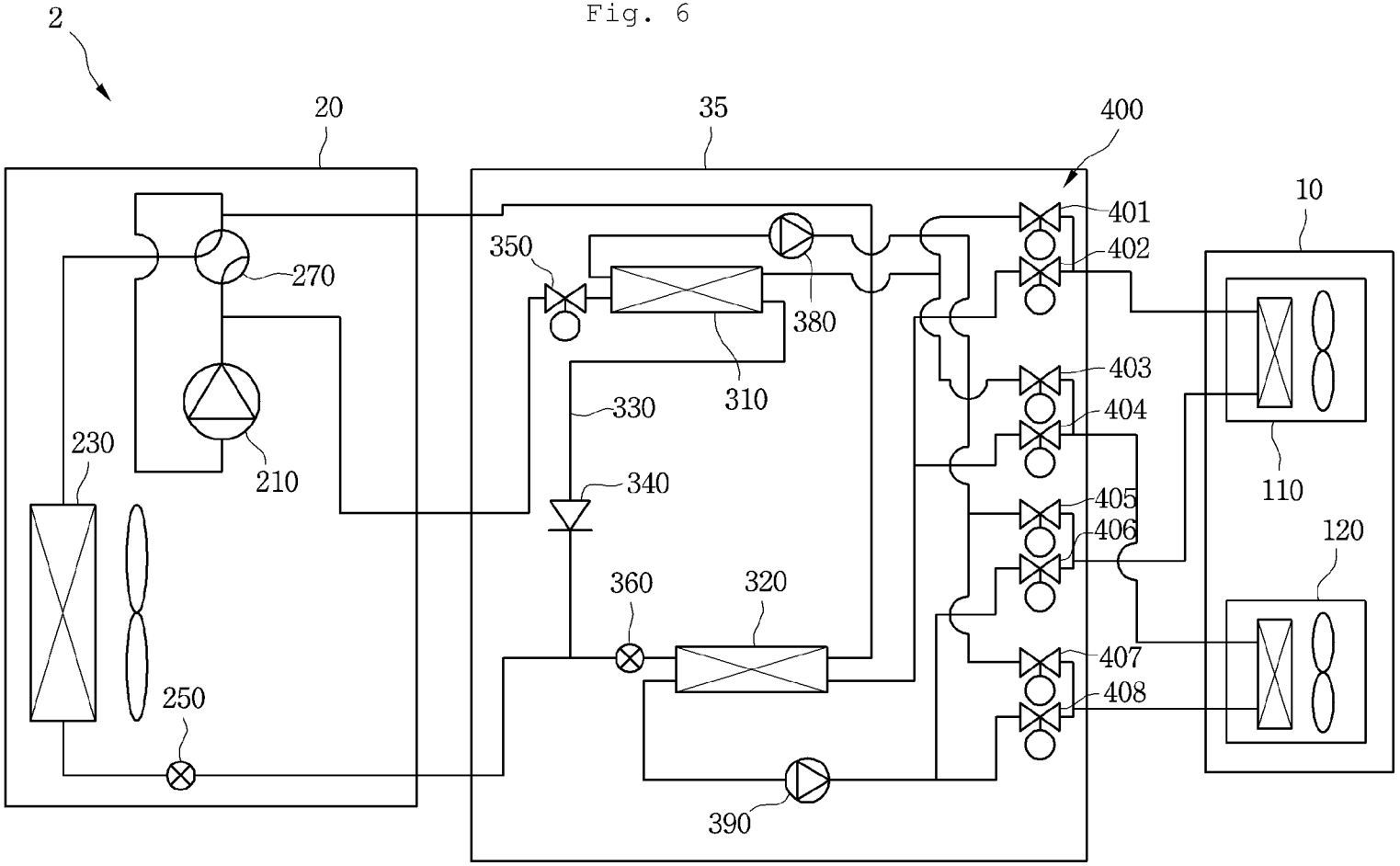
FIG. 6 is a view of an air conditioning system according to another embodiment.

FIG. 6 is a view of an air conditioning system according to another embodiment.

An air conditioning system 2 according to the current embodiment is similar to the air conditioning system 1 according to the foregoing embodiment. Thus, duplicated descriptions with respect to the similar components will be omitted, and different points therebetween will be mainly described below.

Referring to FIG. 6, the air conditioning system 2 includes an outdoor unit 10, an indoor unit 20, and a heat collection unit 35.

The indoor unit 10 is provided in plurality and includes a first indoor unit 110 and a second indoor unit 120. Since the first indoor unit 110 and the second indoor unit 120 are substantially equal or similar to those according to the foregoing embodiment, their duplicated descriptions will be omitted below.

The outdoor unit 20 includes a compressor 210, an outdoor heat exchanger 230, an outdoor unit expansion valve 250, and an outdoor unit four-way valve 270.

Since the compressor 210, the outdoor heat exchanger 230, and the outdoor unit expansion valve 250, and the outdoor unit four-way valve 270 are substantially equal or similar to those according to the foregoing embodiment, their duplicated descriptions will be omitted below.

The heat collection unit 35 includes a first heat exchange part 310, a second heat exchange part 320, a heat exchange part connection tube 330, a check valve 340, a flow rate adjustment valve 350, an expansion valve 360, a first water pump 380, a second water pump 390, and a flow guide valve 400.

Since the first heat exchange part 310, the second heat exchange part 320, the heat exchange part connection tube 330, the check valve 340, the flow rate adjustment valve 350, the expansion valve 360, the first water pump 380, and the second water pump 390 are substantially equal or similar to those according to the foregoing embodiment, their duplicated descriptions will be omitted below.

The flow guide valve 400 is provided in plurality. Unlike the foregoing embodiment, the flow guide valve 400 may include a solenoid valve.

The flow guide valve 400 includes a first guide valve 401, a second guide valve 402, a third guide valve 403, a fourth guide valve 404, a fifth guide valve 405, a sixth guide valve 406, a seventh guide valve 407, and an eighth guide valve 408.

The first flow guide valve 401 guides water introduced into the first indoor unit 110 to the heat collection unit 35 and connects the first indoor unit 110 to the first heat exchange part 310.

The second flow guide valve 402 guides the water introduced into the first indoor unit 110 to the heat collection unit 35 and connects the first indoor unit 110 to the second heat exchange part 320.

The third flow guide valve 403 guides water introduced into the second indoor unit 120 to the heat collection unit 35 and connects the second indoor unit 120 to the first heat exchange part 310.

The fourth flow guide valve 404 guides the water introduced into the second indoor unit 120 to the heat collection unit 35 and connects the second indoor unit 120 to the second heat exchange part 320.

The fifth flow guide valve 405 guides water heat-exchanged in the heat collection unit 35 to the first indoor unit 110 and connects the first indoor unit 110 to the first heat exchange part 310.

The sixth flow guide valve 406 guides the water heat-exchanged in the heat collection unit 35 to the first indoor unit 110 and connects the first indoor unit 110 to the second heat exchange part 320.

The seventh flow guide valve 407 guides the water heat-exchanged in the heat collection unit 35 to the second indoor unit 120 and connects the second indoor unit 120 to the first heat exchange part 310.

The eighth flow guide valve 408 guides the water heat-exchanged in the heat collection unit 35 to the second indoor unit 120 and connects the second indoor unit 120 to the second heat exchange part 320.

Hereinafter, an operation of the air conditioning system 2 according to the current embodiment will be described in more detail.

FIGS. 7 to 10 are views illustrating flows of a refrigerant and water according to various operation modes in the air conditioning system of FIG. 6.

An operation mode of the air conditioning system 2 according to the current embodiment is similar to that of the air conditioning system 1 according to the foregoing embodiment. Thus, duplicated descriptions with respect to the similar operations will be omitted, and different points therebetween will be mainly described below.

Like the foregoing embodiments, in FIGS. 7 to 10, a solid arrow denotes a flow of a refrigerant, and a dotted line arrow denotes a flow of water.

Figure 7:
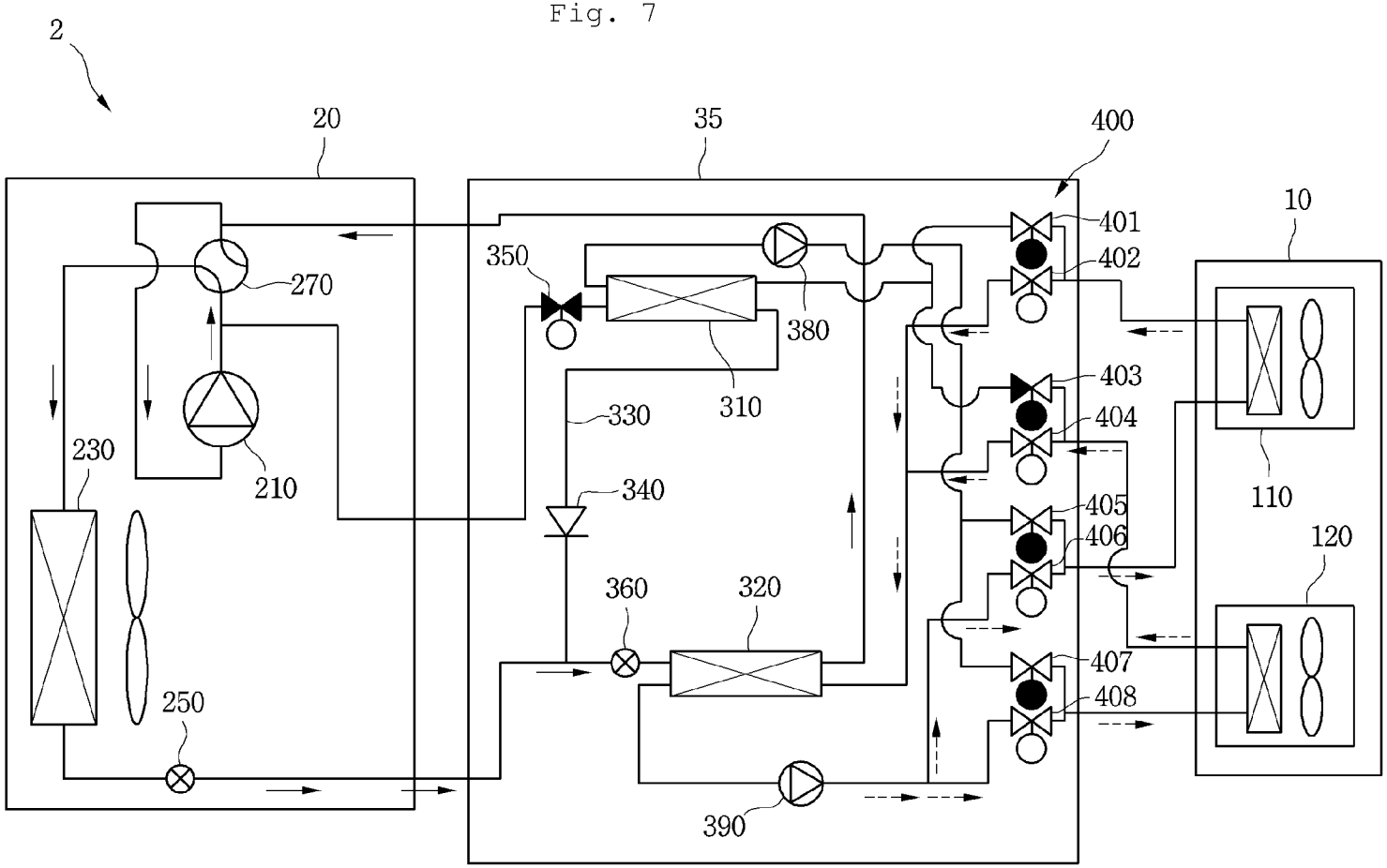
FIGS. 7 to 10 are views illustrating flows of a refrigerant and water according to various operation modes in the air conditioning system of FIG. 6.

FIG. 7 illustrates flows of a refrigerant and water according to a cooling operation mode of the air conditioning system 2 of FIG. 6. Since the flow of the refrigerant is the same as that of the refrigerant according to the foregoing embodiment, a flow of water will be mainly described below.

Referring to FIG. 7, when a cooling operation is performed, the first, third, and fifth guide valves 401, 403, and 405 of the flow guide valve 400 are closed, and the second, fourth, and sixth guide valves 402, 404, and 406 of the flow guide valve 400 are opened.

Thus, cooling water discharged from the first indoor unit 110 is introduced into the second heat exchange part 320 via the second guide valve 402. Also, cooling water exchanged in the second heat exchange part 320 is introduced again into the first indoor unit 110 via the sixth guide valve 406.

The cooling water discharged from the second indoor unit 120 is introduced into the second heat exchange part 320 via the fourth guide valve 404. Also, the cooling water exchanged in the second heat exchange part 320 is introduced again into the second indoor unit 120 via the eighth guide valve 408.

Figure 8:
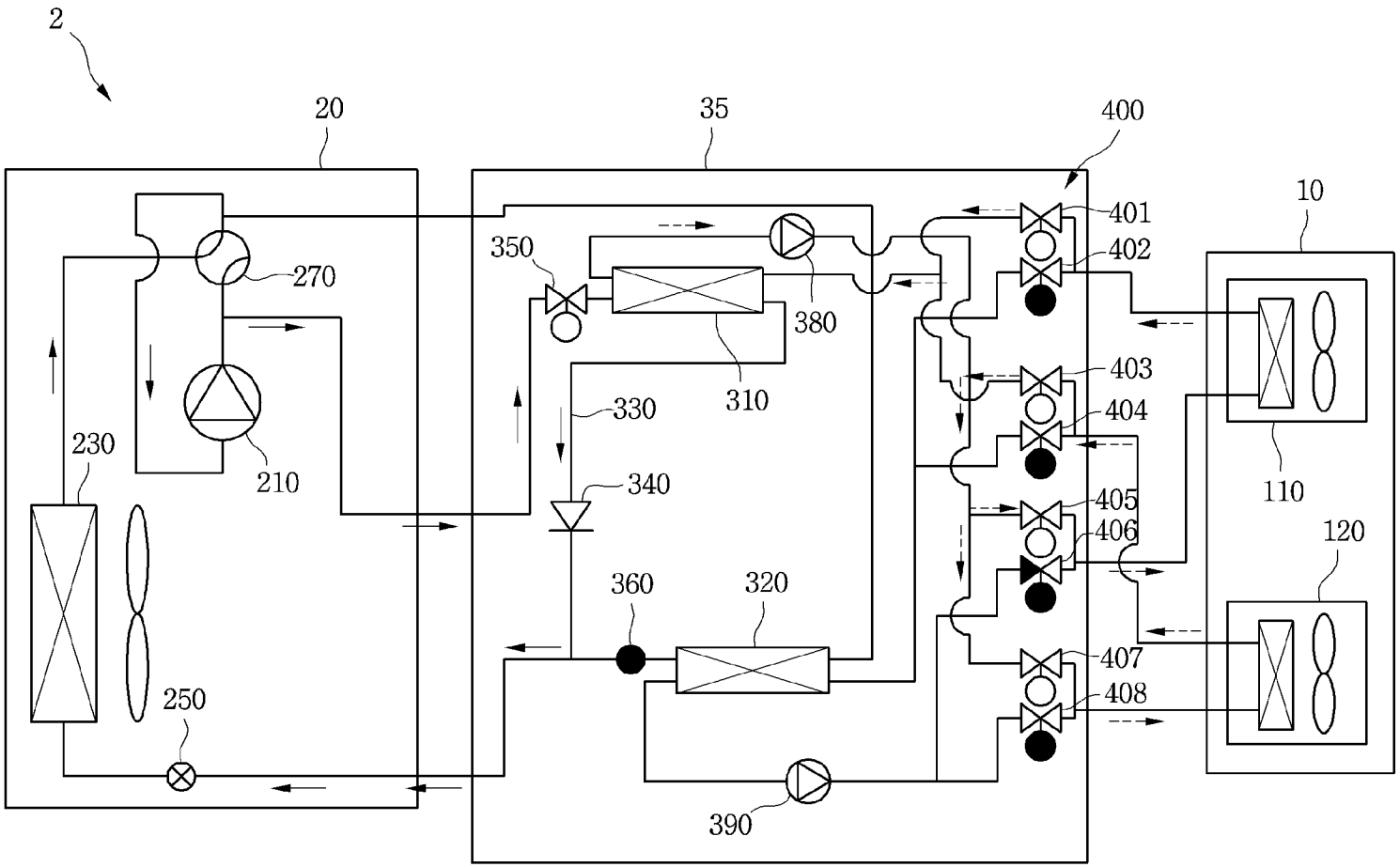

FIG. 8 illustrates flows of a refrigerant and water according to a heating operation mode of the air conditioning system 6 of FIG. 2. Since the flow of the refrigerant is the same as that of the refrigerant according to the foregoing embodiment, a flow of water will be mainly described below.

Referring to FIG. 8, when a heating operation is performed, the first, third, and fifth guide valves 401, 403, and 405 of the flow guide valve 400 are opened, and the second, fourth, and sixth guide valves 402, 404, and 406 of the flow guide valve 400 are closed.

Thus, heating water discharged from the first indoor unit 110 is introduced into the first heat exchange part 310 via the first guide valve 401. Also, heating water exchanged in the first heat exchange part 310 is introduced again into the first indoor unit 110 via the fifth guide valve 405.

The heating water discharged from the second indoor unit 120 is introduced into the first heat exchange part 310 via the third guide valve 403. Also, heating water exchanged in the first heat exchange part 310 is introduced again into the second indoor unit 120 via the seventh guide valve 407.

Figure 9:
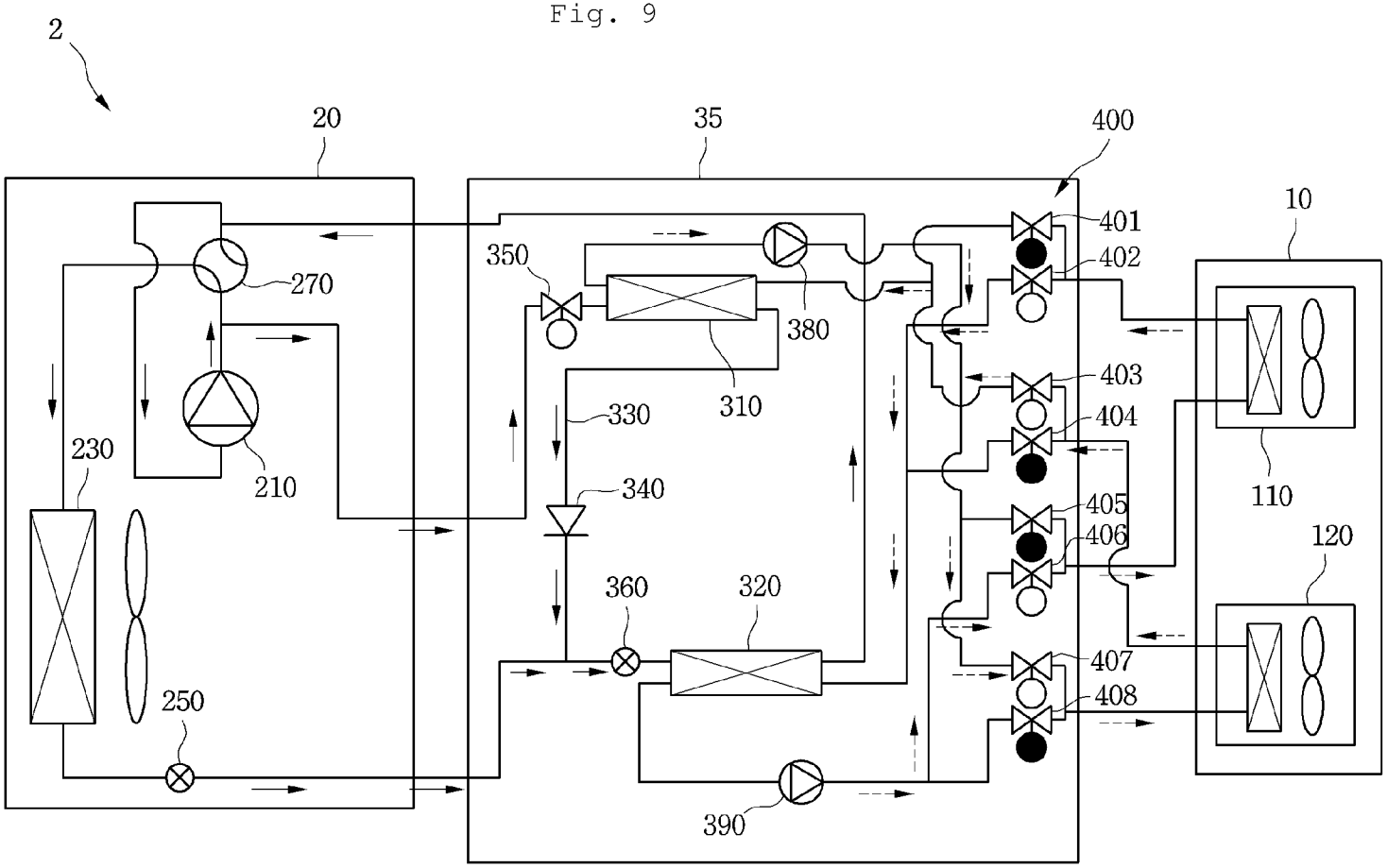

FIG. 9 illustrates flows of a refrigerant and water according to a cooling-main operation mode of the air conditioning system 2 of FIG. 6. Since the flow of the refrigerant is the same as that of the refrigerant according to the foregoing embodiment, a flow of water will be mainly described below.

Referring to FIG. 9, when a cooling-main operation is performed, the first, fourth, and fifth guide valves 401, 404, and 405 of the flow guide valve 400 are closed, and the second, third, and sixth guide valves 402, 403, and 406 of the flow guide valve 400 are opened.

Thus, cooling water discharged from the first indoor unit 110 is introduced into the second heat exchange part 320 via the second guide valve 420. Also, cooling water exchanged in the second heat exchange part 320 is introduced again into the first indoor unit 110 via the sixth guide valve 406.

Also, the heating water discharged from the second indoor unit 120 is introduced into the first heat exchange part 310 via the third guide valve 403. Also, heating water exchanged in the first heat exchange part 310 is introduced again into the second indoor unit 120 via the seventh guide valve 407.

Figure 10:
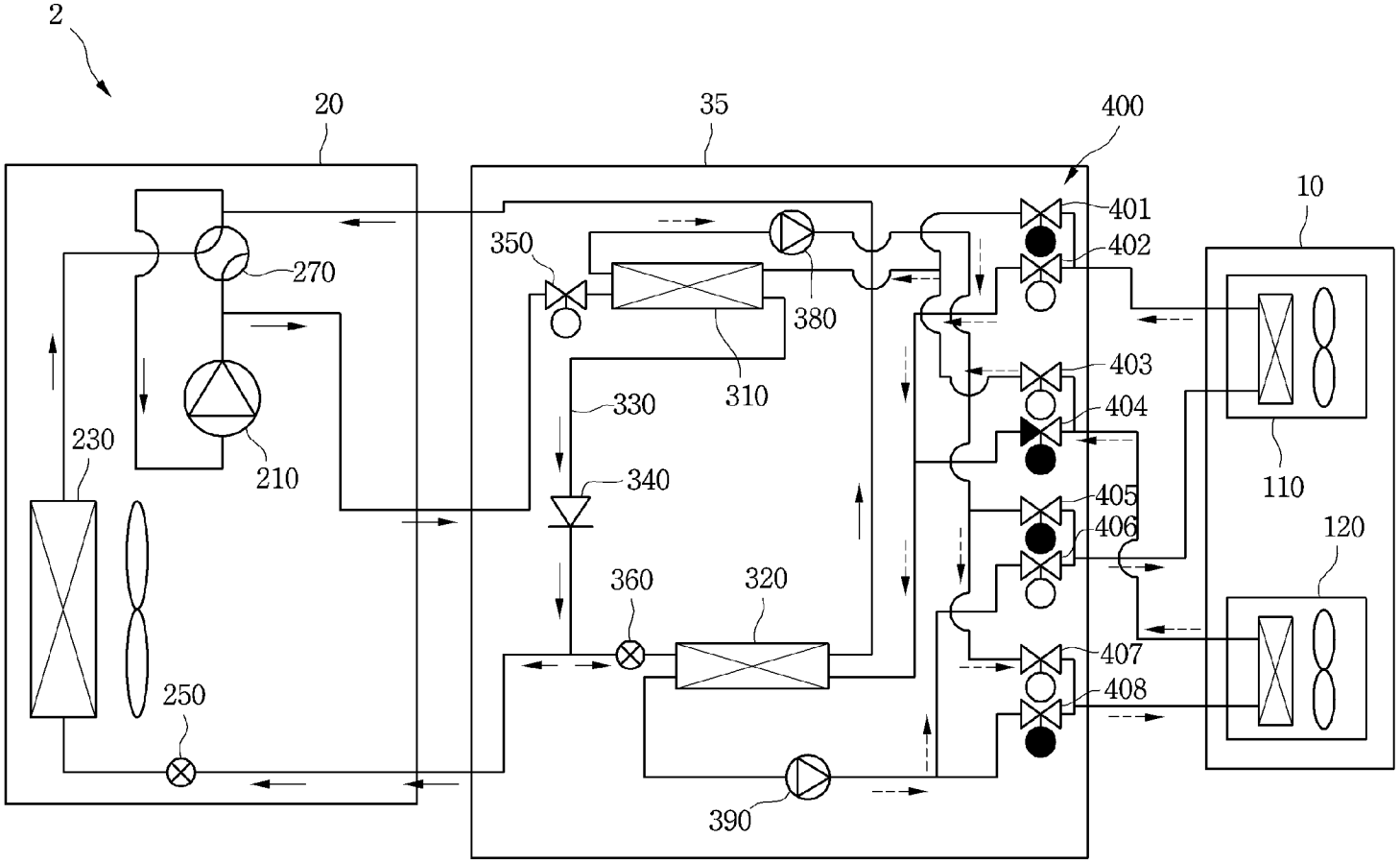

FIG. 10 illustrates flows of a refrigerant and water according to a heating-main operation mode of the air conditioning system 2 of FIG. 6. Since the flow of the refrigerant is the same as that of the refrigerant according to the foregoing embodiment, a flow of water will be mainly described below.

Referring to FIG. 10, when a heating-main operation is performed, the first, fourth, and fifth guide valves 401, 404, and 405 of the flow guide valve 400 are closed, and the second, third, and sixth guide valves 402, 403, and 406 of the flow guide valve 400 are opened.

Thus, cooling water discharged from the first indoor unit 110 is introduced into the second heat exchange part 320 via the second guide valve 420. Also, cooling water exchanged in the second heat exchange part 320 is introduced again into the first indoor unit 110 via the sixth guide valve 406.

Also, the heating water discharged from the second indoor unit 120 is introduced into the first heat exchange part 310 via the third guide valve 403. Also, heating water exchanged in the first heat exchange part 310 is introduced again into the second indoor unit 120 via the seventh guide valve 407.

As described above, in the air conditioning system 2 according to the current embodiment, the flow guide valve 400 may be provided as a solenoid valve, but a three-way valve. That is, the flow guide valve 400 may be provided as a valve that is capable of adequately distributing or guiding water introduced from the indoor unit 10 in consideration of various design conditions such as the costs or time.

According to the various embodiments as described above, the air conditioning system that is capable of reducing the amount of refrigerant in the whole system, preventing the refrigerant from leaking, and improving the easy maintenance and partial load efficiency may be provided.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioning system comprising:

an indoor unit;

an outdoor unit comprising a compressor to compress a refrigerant and an outdoor heat exchanger to provide a heat-exchange with the refrigerant; and a heat collection unit to connect the indoor unit to the outdoor unit, the heat collection unit comprising a pair of heat exchange parts to heat-exchange water that is supplied from the indoor unit with the refrigerant that is supplied from the outdoor unit, wherein the indoor unit and the heat collection unit are connected to each other by a water tube through which the water circulates, and the outdoor unit and the heat collection unit are connected to each other by a first refrigerant tube and a second refrigerant tube, wherein the pair of heat exchange parts comprise:

a first heat exchange part coupled to the indoor unit via the water tube and the compressor of the outdoor unit via the first refrigerant tube; and a second heat exchange part coupled to the indoor unit via the water tube and the outdoor heat exchanger of the outdoor unit via the second refrigerator tube, wherein the heat collection unit comprises a flow rate adjustment valve provided in the first refrigerant tube between the compressor of the outdoor unit and the first heat exchange part to adjust a flow rate of the refrigerant;

a heat exchange part connection tube to connect the first heat exchange part to the second refrigerator tube and through which the refrigerant of the outdoor unit circulates;

a check valve provided in the heat exchange part connection tube to prevent the refrigerant from flowing to the first heat exchange part; and an expansion valve provided in the second refrigerant tube, wherein the outdoor unit further comprises an outdoor unit expansion valve provided in the second refrigerant tube, wherein the heat exchange part connection tube comprises a first end connected to the first heat exchange part, and a second end connected to a portion between the expansion valve and the outdoor unit expansion valve, wherein the flow rate adjustment valve is closed during a cooling operation and is open during a heating operation, and wherein the expansion valve is closed during the heating operation, whereby the refrigerant passes through the second heat exchange part and bypasses the first heat exchange part during the cooling operation, and whereby the refrigerant passes through the first heat exchange part and bypasses the second heat exchange part during the heating operation.

2. The air conditioning system of claim 1, wherein the heat collection unit comprises a pair of flow guide valves to guide the water introduced from the indoor unit to the first heat exchange part or the second heat exchange part and to guide the water discharged from the first heat exchange part or the second heat exchange part to the indoor unit.

3. The air conditioning system of claim 2, further comprising more than one pair of the flow guide valves.

4. The air conditioning system of claim 2, wherein the pair of flow guide valves comprises a three-way valve.

5. The air conditioning system of claim 2, wherein the pair of flow guide valves comprises a solenoid valve.

6. The air conditioning system of claim 1, wherein the outdoor unit further comprises an outdoor unit four-way valve coupled to the first heat exchange part to convert a flow of the refrigerant.

7. The air conditioning system of claim 1, wherein the heat collection unit comprises a first water pump provided between the first heat exchange part and the indoor unit to provide a flow force for the water flowing in the first heat exchange part.

8. The air conditioning system of claim 1, wherein the heat collection unit comprises a second water pump provided between the second heat exchange part and the indoor unit to provide a flow force for the water in the second heat exchange part.

9. The air conditioning system of claim 1, wherein the first heat exchange part is for heating, and the second heat exchange part is for cooling.

10. The air conditioning system of claim 1, wherein the pair of heat exchange parts are plate type heat exchangers.

* * * * *